US005478636A

United States Patent [19]

Koseki

[11] Patent Number: 5,478,636

[45] Date of Patent: Dec. 26, 1995

[54] SHOCK ABSORBING BELT FOR CHILD

[75] Inventor: Tomohiro Koseki, Hamamatsu, Japan

[73] Assignees: Ikeda Bussan Co., Ltd., Ayase; Hamamatsu Industry Co., Ltd., Hamamatsu, both of Japan

[21] Appl. No.: 402,047

[22] Filed: Mar. 10, 1995

[30] Foreign Application Priority Data

Mar. 11, 1994 [JP] Japan ..... 6-068055

[51] Int. Cl.[6] ..... D03D 3/00

[52] U.S. Cl. ..... 428/229; 139/426 R; 428/225; 428/257; 428/902; 297/483

[58] Field of Search ..... 139/426 R; 428/225, 428/229, 257, 902; 297/483

[56] References Cited

U.S. PATENT DOCUMENTS 4,662,487 5/1987 Koch ..... 188/371
5,376,440 12/1994 Hoseki ..... 428/257

FOREIGN PATENT DOCUMENTS 54-20732 7/1979 Japan .
60-261474 12/1985 Japan .

*Primary Examiner*—James J. Bell
*Attorney, Agent, or Firm*—Foley & Lardner

[57] ABSTRACT

A shock absorbing belt for a child, of a seat belt restraint system or of a child seat in an automotive vehicle. The shock absorbing belt comprises base yarns including warp and weft yarns which are interlaced with each other. A plurality of additional yarns are inserted along the longitudinal direction of the warp yarns and at predetermined intervals in the longitudinal direction of each weft yarn. The additional yarns are lower in elongation percentage and higher in strength than the base yarns. Each additional yarn is placed between upper weft yarns and lower weft yarns. The additional yarns have a total size of not more than 12000 D/cm, and a yarn size of not more than 1500 D. Each additional yarn is breakable when a high impact load is applied to the shock absorbing belt.

7 Claims, 3 Drawing Sheets

SHOCK ABSORBING BELT FOR CHILD

BACKGROUND OF THE INVENTION

1. Field of the Invention

This invention relates to improvements in a shock absorbing belt for a child, of a seat belt restraint system (for a child or of a child seat) arranged to protect a child occupant in an automotive vehicle, an airplane, or the like, when the occupant is subjected to an impact during a high speed cruising, or a collision of the vehicle, or falling of the airplane.

2. Description of the Prior Art

Hitherto seat belt restraint systems as protecting devices for an occupant have been known in the field of automotive vehicles and airplanes. A typical seat belt restraint system will be discussed with reference to FIG. 4 which shows the fabric structure of a seat belt forming part of the system. The fabric structure is woven by interlacing warp yarns 2 and weft yarns as base yarns. The fabric structure of FIG. 4 is of a 2/2 twill weave, and may be of a 4/4 twill weave.

In an example of such a seat belt for an adult, the warp yarns have a size of 1000 to 1500 D, a breaking strength of 8 to 10 g/D, and an elongation percentage of 10 to 20%. Additionally, the weft yarns have a size of 500 to 750 D, a breaking strength of 5 to 7 g/D, and an elongation percentage of 15 to 25%.

Now, recently energy absorbing belts for absorbing impact have been proposed as disclosed in Japanese Patent Publication No. 54-20732 and Japanese Patent Provisional Publication No. 60-261474. The energy absorbing belt, as disclosed in Japanese Patent Publication No. 54-20732, uses two different kinds of warp yarns, in which at least one of the two kinds of the warp yarns is formed of an aromatic polyamide fiber or an aromatic polyhydrazide-polyamide copolymer fiber. The energy absorbing belt, as disclosed in Japanese Patent Provisional Publication No. 60-261474 uses a kind of additional yarns in addition to base yarns, so the base yarns largely deform as compared with the additional yarns when the same force is applied to the base yarns and the additional yarns. Thus, the above energy absorbing belts are arranged to plastically deform when they absorb an impact energy.

However, drawbacks have been encountered in the above discussed conventional seat belts or energy absorbing belts as set forth below.

Concerning the above-mentioned conventional seat belt for an adult, although the seat belt has a low elongation percentage of 3 to 8% in its longitudinal direction, the timing of an initial restraint for an occupant is unavoidably retarded because a drawing-out action of the seat belt occurs after stopping of rotation (for drawing out the belt) of a belt winding-up shaft of a seat belt retractor. As a result, the occupant cannot be sufficiently restrained and protected from a secondary collision.

Additionally, as seen in FIG. 5, which shows load-elongation characteristics of the conventional seat belt formed of polyester fiber, the primary rise of a load-elongation curve is gentle, and therefore, the timing of the initial restraint of the occupant is retarded, thereby making it impossible to sufficiently restrain and protect the occupant. Additionally, although an outlet locking mechanism has been proposed to prevent the above-mentioned drawing-out action of the seat belt from the retractor, the mechanism is expensive and provides the possibility of the belt being broken.

Concerning the above-mentioned energy absorbing belt, as disclosed in Japanese Patent Provisional Publication No. 54-20732, the warp yarns constituting the belt include a kind of warp yarns, that are woven in tile fabric structure so-called to have a so-called weaving shrinkage percentage less than that of another kind of warp yarns, which are also woven in the fabric structure. The primary rise in the load-elongation characteristics of the belt can be obtained by the warp yarns having the less weaving shrinkage percentage; however, the warp yarns are woven in, and therefore, unavoidably elongate though they are less in the weaving shrinkage percentage. Therefore, this energy absorbing belt has a such a defect that the timing of the primary rise or initial restraint for the occupant is unavoidably retarded, which makes it impossible to reduce a head injury criteria (HIC) according to FMVSS No. 208.

Concerning the above-mentioned energy absorbing belt, as disclosed in Japanese Patent Provisional Publication No. 60-261474, base materials (yarns) and additional materials (yarns) constituting the fabric structure of the belt are, respectively, provided with different elongation characteristics under a mechanical pretreatment and/or a pretreatment with a heating device, made at the time of interlacing them with each other. The mechanical pretreatment is accomplished to set the yarns at a predetermined elongation percentage value by application of elongation, contraction and/or twist to the yarns. The treatment with the heating device is accomplished by elongating the yarns in a hot condition, then contracting them, and thereafter cooling them.

Accordingly, this energy absorbing belt cannot be produced without troublesome processes thereby making difficult production thereof, and thus, raising a production cost thereof. Additionally, this energy absorbing belt is inferior in the characteristics of the initial restraint for the occupant, and insufficient in energy absorbing effect thereby making it difficult to sufficiently soften an impact applied to the vehicle occupant during a vehicle collision.

It is to be noted that the above-discussed seat belt and energy absorbing belts are used for adult occupants, and therefore, poor in energy absorbing ability for children who are light in weight so as to be low in reduction effect for the head injury criteria (HIC) at a vehicle collision or the like.

SUMMARY OF THE INVENTION

It is an object of the present invention to provide an improved shock absorbing belt for a child, which can overcome drawbacks encountered in conventional shock absorbing belts used in a child seat, a seat belt restraint system of an automotive vehicle, or an airplane.

Another object of the present invention is to provide an improved shock absorbing belt for a child, which provides safety for a child and can accomplish a sufficient restraint action to the child at a vehicle collision or the like while reducing a head injury criteria (HIC) for the child.

A further object of the present invention is to provide an improved shock absorbing belt for a child, which can promptly accomplish an initial restraint for the child who is light in weight, during a vehicle collision or the like.

A still further object of the present invention is to provide an improved shock absorbing belt for a child, which can sustain a load for a predetermined time at a set load or load limit (fuse load), and enlarges a fuse elongation amount thereby to maintain the fuse load for a relatively long time.

A shock absorbing belt of the present invention is for a child. The shock absorbing belt comprises base yarns include warp and weft yarns which are interlaced with each other. Additionally, a plurality of additional yarns are inserted along a longitudinal direction of the warp yarns and at predetermined intervals in a longitudinal direction of each weft yarn. The additional yarns are lower in elongation percentage and higher in strength than the base yarns. Each additional yarn is placed between first weft yarns and second weft yarns, which are respectively located on upper and lower sides of each additional yarn. The additional yarns have a total size of not more than 12000 D/cm and a yarn size of not more than 1500 D. Each additional yarn is breakable when a high impact load is applied to the shock absorbing belt.

With the shock absorbing belt of the present invention, when an impact load over a predetermined level is applied to the belt, the additional yarns randomly break along the longitudinal direction thereof, as the warp yarns of the base yarns are elongating. This is because each additional yarn is placed tightly between the upper and the lower weft yarns under a tightly supported condition at a plurality of positions along the longitudinal direction of the weft yarn. Accordingly, a load (of a child) applied to the belt is sustained for a predetermined time at a set load (fuse load) for children. As a result, the fuse load is maintained for a relatively long time thereby effectively absorbing the energy of the impact load. Additionally, the shock absorbing belt promptly accomplishes the initial restraint for a child occupant, thereby effectively lowering an head injury criteria(HIC) of children.

DETAILED DESCRIPTION OF THE INVENTION

Figure 1:
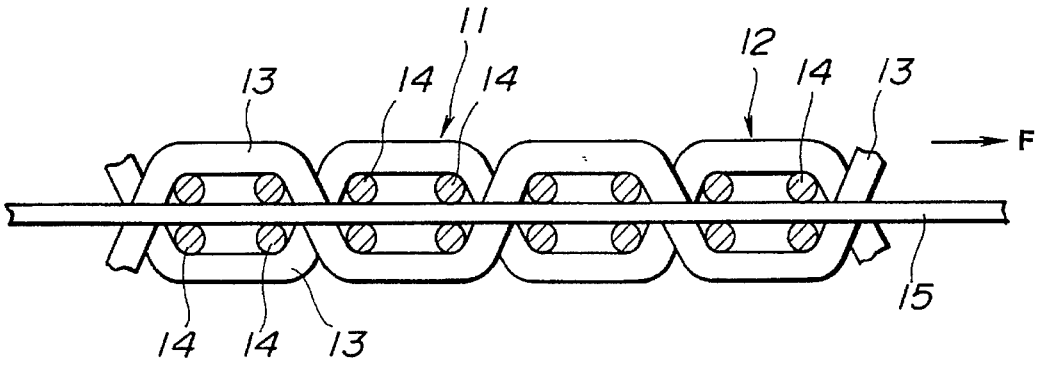
FIG. 1 is a schematic enlarged fragmentary sectional view of a fabric structure of an embodiment of a shock absorbing belt for a child, in accordance with the present invention.
Figure 2:
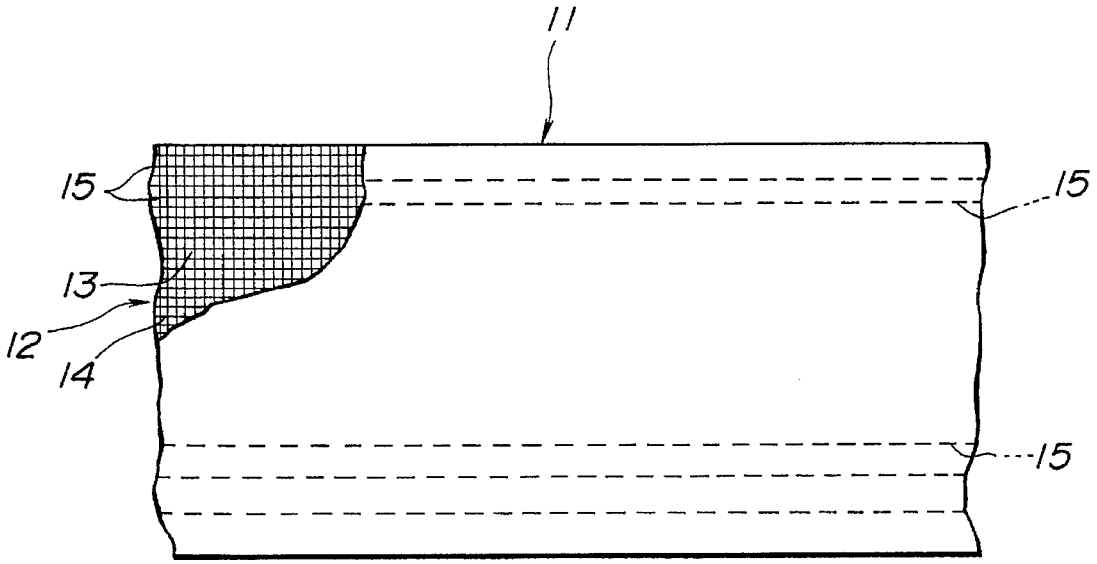
FIG. 2 is a fragmentary plan view, partly in section, of the shock absorbing belt of FIG. 1.

Referring now to FIGS. 1 and 2 of the drawings, an embodiment of a shock absorbing belt for a child, according to the present invention is illustrated by the reference numeral 11. The shock absorbing belt 11 is used for a variety of seat belt restraint systems (not shown) for a child, and used in child seats. The seat belt restraint systems and the child seats are, for example, for automotive vehicles and for airplanes. The shock absorbing belt 11 may be used for a seat belt restraint system provided with a seat belt tensioner that can wind up a seat belt upon sensing an impact. The shock absorbing belt 11 of this embodiment is for the seat belt restraint system of an automotive vehicle (not shown).

The shock absorbing belt 11 has a fabric structure which is formed upon being woven with warp yarns 13 and weft yarns 14 as base yarns 12. Additionally, additional yarns 15 having a low elongation percentage and high strength are woven in the fabric structure along the longitudinal direction of the warp yarns 13 and interlaced with weft yarns 14 in such a manner to be located at predetermined intervals in the longitudinal direction of each weft yarn 14.

The additional yarns 15 are woven in the fabric structure and placed between the upper and lower weft yarns 14, 14 which are successively interlaced with the weft yarns 13 along the longitudinal direction of each warp yarn 13. In other words, as shown in FIG. 1, two weft yarns 14, 14 are interlaced with the warp yarns 13, in which each additional yarn 15 is placed between the upper two weft yarns 14, 14 and the lower two weft yarns 14, 14 so as to be supported under a tightening pressure from the base yarns 12 (13, 14). In FIG. 1, an arrow F indicates a direction at which a load is applied to the warp yarns 13 when the shock absorbing belt 11 restrains a child during a vehicle collision.

While the fabric structure of the shock absorbing belt 11 of the above embodiment has been shown and described as being formed into a 2/2 twill weave (two warp yarns are interlaced with two weft yarns), it will be understood that it may be formed into a 4/4 twill weave (four warp yarns are interlaced with four weft yarns) or into other weaving patterns in which the additional yarns 15 can be linearly woven in the fabric structure.

In this embodiment, the warp yarns 13 of the base yarns 12 are formed of high viscosity ($\eta$) high polymer polyester fiber, or nylon fiber and have a total size of not more than 40000 D (denier)/cm, preferably not more than 35000 D/cm. Each warp yarn 13 has a yarn size of not more than 2000 D, preferably not more than 1500 D. The term total size means the total denier per a width of 1 cm, while the term yarn size means the denier of each yarn.

The weft yarns 14 of the base yarns 12 are formed of polyester fiber or nylon fiber and have a total size of not less than 15000 D/cm, preferably not less than 20000 D/cm. Each weft yarn 14 has a yarn size of not less than 1000 D, preferably not less than 250 D. The percentage of the total size of the weft yarn 14 is not less than 27%, preferably not less than 36%, relative to the basic yarns 12.

The additional yarns 15 are formed of a high strength and high modulus (Young's modulus) fiber, such as wholly-aromatic polyester (polyarylate) fiber, wholly-aromatic polyaramide (para-type aramide) fiber, or carbon fiber. The additional yarns 15 have the total size of not more than 12000 D/cm, and the yarn size of not more than 1500 D, preferably not more than 1100 D. The additional yarns 15 have a dry strength of not less than 10 g/D, preferably not less than 20 g/D, and an elongation percentage of not more than 10 %, preferably not more than 4%. The term elongation percentage means the percentage of elongation of the yarn relative to the initial length of the yarn.

The shock absorbing belt 11 has a tensile strength of not more than 1000 kgf, preferably not more than 500 kgf, and an elongation percentage (at 220 kgf) of not less than 5%, preferably not less than 7%. It will be understood that the elongation percentage of the belt 11 is the percentage of elongation relative to the initial length of the belt 11. Additionally, the shock absorbing belt 11 has a work amount (at 220 kgf) of 5 kgf·m/m, preferably 10 kgf·m/m. The term work amount means an amount of work made by the shock absorbing belt 11 when a load of 220 kgf is applied to the shock absorbing belt 11.

Figure 3:
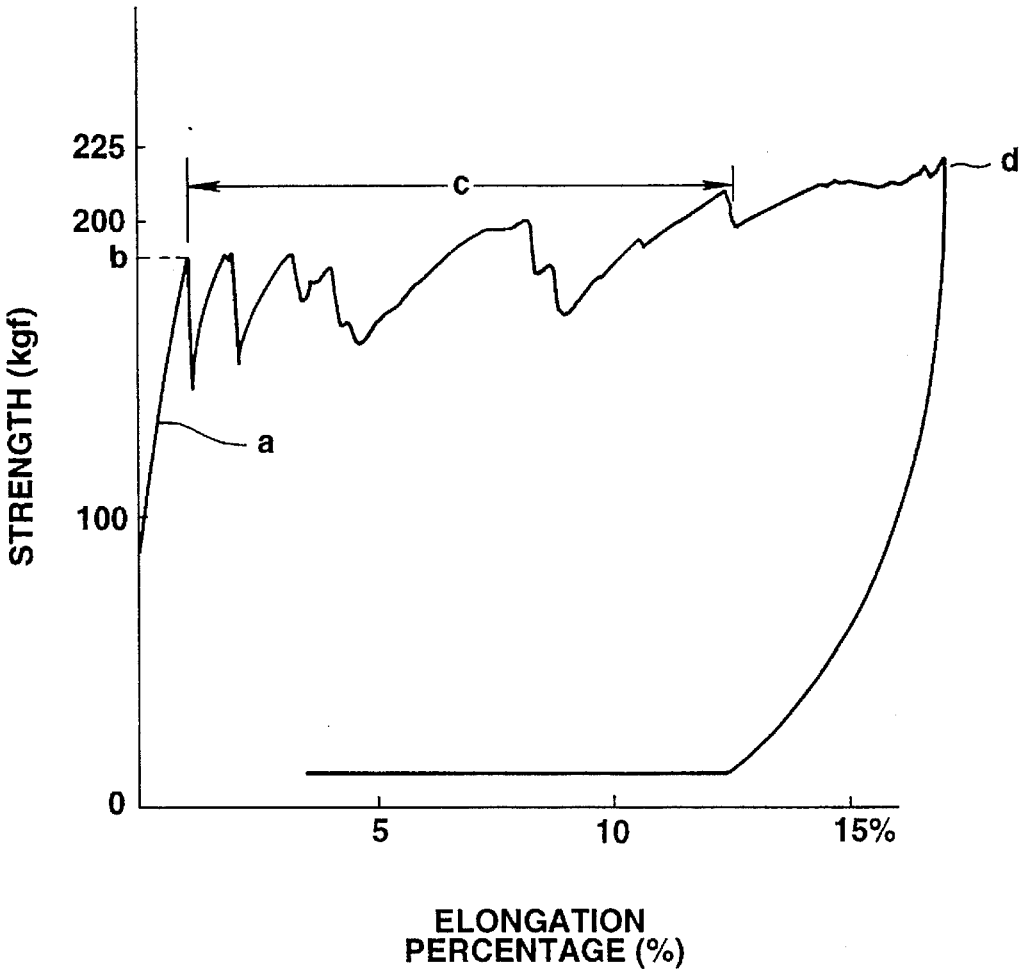
FIG. 3 is a graph showing a load-elongation characteristics of the shock absorbing belt of FIG. 1.
Figure 4:
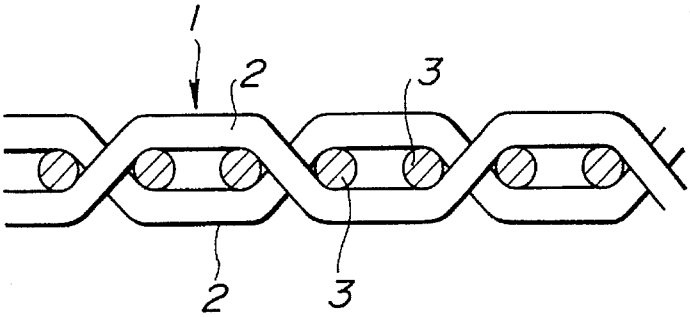
FIG.4 (PRIOR ART)
FIG. 4 is a schematic enlarged fragmentary sectional view of a fabric structure of a seat belt for a child.
Figure 5:
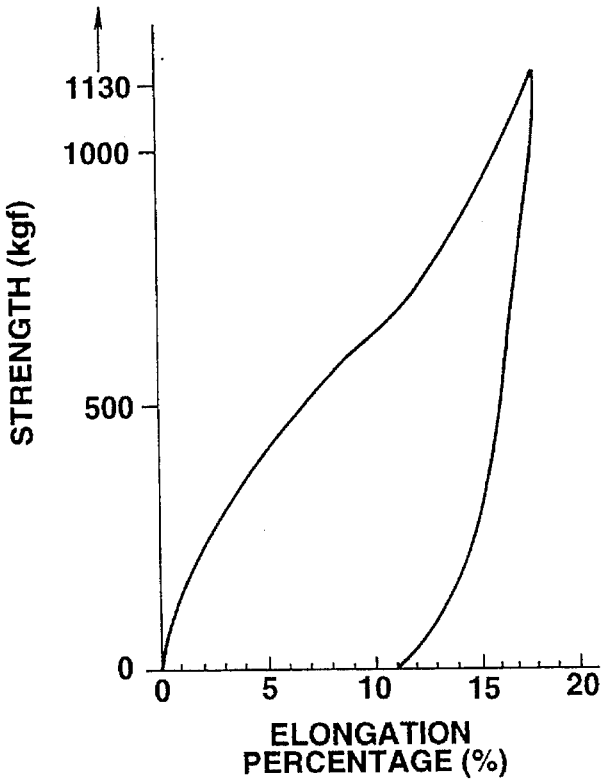
FIG.5 (PRIOR ART)
FIG. 5 is a graph showing a load-elongation characteristics of the conventional seat belt of FIG. 4.

The shock absorbing belt 11 has a load-elongation characteristics shown in FIG. 3, which was obtained experimentally under an elongation test. The function of the shock absorbing belt 11 will be discussed with reference to the graph of FIG. 3.

First, when a tensile load was applied to the shock absorbing belt 11, a primary rise a providing an initial restraining (for a vehicle occupant) could be obtained. At this time, each additional yarn 15 was placed tightly between the upper and lower weft yarns 14, 14 under a tightly supported condition at a plurality of positions along the longitudinal direction of the weft yarn 13. Then, the additional yarn 15 reached a point b at a predetermined fuse load as the warp yarns 13 of the base yarns 12 were elongating. At this time, the additional yarns 15 broke randomly along their longitudinal direction to exhibit a fuse elongation amount c.

After completion of elongation of the fuse elongation amount c, the shock absorbing belt 11 elongated to a point d at which it receives a load of 220 kg.

During the elongation of the fuse elongation amount c in which the additional yarns 15 broke, each additional yarn was in a condition of random breaking at a plurality of positions along the longitudinal direction thereof. The breakage of each additional yarn 15 was made at intervals of 2 to 10 cm.

Thus, according to the above embodiment of the shock absorbing belt 11, each additional yarn is placed between the upper and the lower weft yarns under a condition tightly supported at a plurality of positions along the longitudinal direction of the weft yarn. Accordingly, when an impact load is applied to the belt, each additional yarn is placed tightly between the upper and the lower weft yarns under pressure and along the longitudinal direction of the warp yarns. As the base yarns are elongating, each additional yarn breaks along its longitudinal direction so that the fuse elongation amount is enlarged thereby sustaining the fuse load for a relatively long time. This effectively absorbs the energy of the impact load.

What is claimed is:

1. A shock absorbing belt for a child, comprising:

base yarns including warp and weft yarns which are interlaced with each other; and a plurality of additional yarns which are lower in elongation percentage and higher in strength than said base yarns, said additional yarns being inserted along a longitudinal direction of the warp yarns and at predetermined intervals in a longitudinal direction of each weft yarn, each additional yarn being put between first weft yarns and second weft yarns which are respectively located on upper and lower sides of each additional yarn, said additional yarns having a total size of not more than 12000 D/cm and a yarn size of not more than 1500 D, each additional yarn being able to break when a high impact load is applied to said shock absorbing belt.

2. A shock absorbing belt as claimed in claim 1, wherein said additional yarns are higher in Young's modulus than said base yarns.

3. A shock absorbing belt as claimed in claim 1, wherein said additional yarns have a yarn size of not more than 1100 D.

4. A shock absorbing belt as claimed in claim 1, wherein said warp yarns of said base yarns have a total size of not more than 40000 D/cm and a yarn size of not more than 2000 D, each warp yarn being formed of one selected from the group consisting of high viscosity polyester fiber and nylon fiber, wherein each additional yarn is formed of one selected from the group consisting of wholly-aromatic polyester fiber, wholly-aromatic polyaramide fiber, and carbon fiber.

5. A shock absorbing belt as claimed in claim 4, wherein said warp yarn have a total size of not more than 35000 D/cm.

6. A shock absorbing belt as claimed in claim 1, further comprising means by which said shock absorbing belt has a tensile strength of not more than 1000 kgf, an elongation percentage (at 220 kgf) of not less than 5%, and a work amount (at 220 kgf) of not less than 5 kgf·m/m.

7. A shock absorbing belt as claimed in claim 6, further comprising means by which said shock absorbing belt has a tensile strength of not more than 500 kgf, and an elongation percentage (at 220 kgf) of not less than 7%, and a work amount of not less than 10 kgf·m/m.

* * * * *